United States Patent [19]

Garzon

[11] 4,440,997

[45] Apr. 3, 1984

[54] PUFFER INTERRUPTER WITH ARC ENERGY ASSIST

[75] Inventor: Ruben D. Garzon, Malvern, Pa.

[73] Assignee: Brown Boveri Electric Inc., Rolling Meadows, Ill.

[21] Appl. No.: 382,920

[22] Filed: May 28, 1982

[51] Int. Cl.[3] ..... H01H 33/88

[52] U.S. Cl. ..... 200/148 A; 200/150 G

[58] Field of Search ..... 200/148 A, 150 G

[56] References Cited

U.S. PATENT DOCUMENTS 4,046,978 9/1977 Badon ..... 200/148 A 4,230,920 10/1980 Thaler ..... 200/148 A

*Primary Examiner*—Robert S. Macon

*Attorney, Agent, or Firm*—Ostrolenk, Faber, Gerb & Soffen

[57] ABSTRACT

A puffer interrupter with arc energy assist employs a cylinder which moves telescopically over a stationary piston. The cylinder carries a movable contact structure and an insulation nozzle and moves within an insulation chamber. The cylinder has an extending flange slidably sealed to the interior of the housing. The flange has a surface which faces the gas volume which is expanded during arc current interruption so that a force is applied to the cylinder which adds to the force of an operating mechanism connected to the cylinder in order to operate the interrupter to its open position.

14 Claims, 2 Drawing Figures

PUFFER INTERRUPTER WITH ARC ENERGY ASSIST

BACKGROUND OF THE INVENTION

This invention relates to circuit interrupters and more specifically relates to a novel puffer interrupter having arc energy assist for operating the interrupter contacts during high current arc interruption operation.

Puffer-type interrupters are well known and commonly consist of a cooperating movable and stationary contact, with the movable contact carrying a nozzle which defines an axial gas flow path in the area between the separating contacts when the contacts are opened. The moving contact and the nozzle carried thereby are commonly fixed to a cylinder which moves relative to a fixed piston so that, during the interrupting operation, the volume between the piston and cylinder is compressed and produces a flow of gas through the nozzle and, thus, through the arc drawn between the separating contacts. The gas commonly is an electronegative gas such as sulfur hexafluoride which may be under atmospheric, or some relatively low positive pressure. An operating mechanism of any desired type is connected to the movable contact and nozzle assembly.

In a puffer interrupter, a relatively large energy output is required from the operating mechanism to provide the necessary force to compress and move gas through the arc space. The operating energy needed from the operating mechanism increases also as a function of the current being interrupted for the following reasons:

First, the ability of the puffer breaker to interrupt current is generally related to the differential pressure across the nozzle which is produced by the movement of the relatively movable piston and cylinder within the puffer interrupter. It is necessary, as interrupting current level increases, to increase the diameter of the nozzle in order to control "clogging" of the nozzle. However, increased nozzle diameter implies increased mass flow of gas, so that to develop the desired differential pressure across the nozzle, the compression piston must be enlarged or the operating volume of the compression piston must be increased. In either case, the mechanism energy needed for moving the movable contact assembly must be further increased.

Secondly, as the interrupting current level increases, the arc energy input into the breaker is increased and the pressure and temperature of the gas being compressed is increased proportionally. A further increase in operating mechanism energy is required to overcome the gas pressure force which opposes movement of the nozzle assembly.

BRIEF DESCRIPTION OF THE INVENTION

In accordance with the present invention, a novel puffer interrupter structure is provided wherein the arc energy is employed to drive the piston assembly toward its open position, with the force derived from the arc energy increasing proportionally to the arc energy. The arc energy assist of the invention comes into play only at higher interrupter current levels. At lower interrupter current levels, the interruption process takes place independently of the arc energy assist.

In accordance with one embodiment of the invention, the movable cylinder of the puffer interrupter has an extending flange which faces the arcing area. Thus, gas pressure is applied to this flange in the same direction as the operating mechanism force during an interruption operation. The puffer cylinder flange is slidably sealed to the interior of the puffer interrupter chamber for almost the full cylinder stroke. The sealed connection between the flange and the chamber interior is opened toward the end of the interrupter opening motion is that the interrupter can be easily reset to a closed position.

By employing the direct assist of the driving force on the movable cylinder as a function of the arc energy produced by the arc, the compression rate of the gas within the arcing volume and the assist force on the piston become a function of the current being interrupted. Thus, in accordance with the invention, for low current and for currents up to load current and medium fault current, the interrupter will act as a conventional puffer interrupter in that gas is compressed by the moving cylinder and no significant pressure is generated by the low arc current so that the breaker does not experience difficulties in interruption. At larger currents, however, the arc energy, which is liberated by the interruption process, produces a force on the movable cylinder which assists the operating mechanism so that no significant increase in mechanism output at higher interrupting current is needed.

DETAILED DESCRIPTION OF THE DRAWINGS

Figure 1:
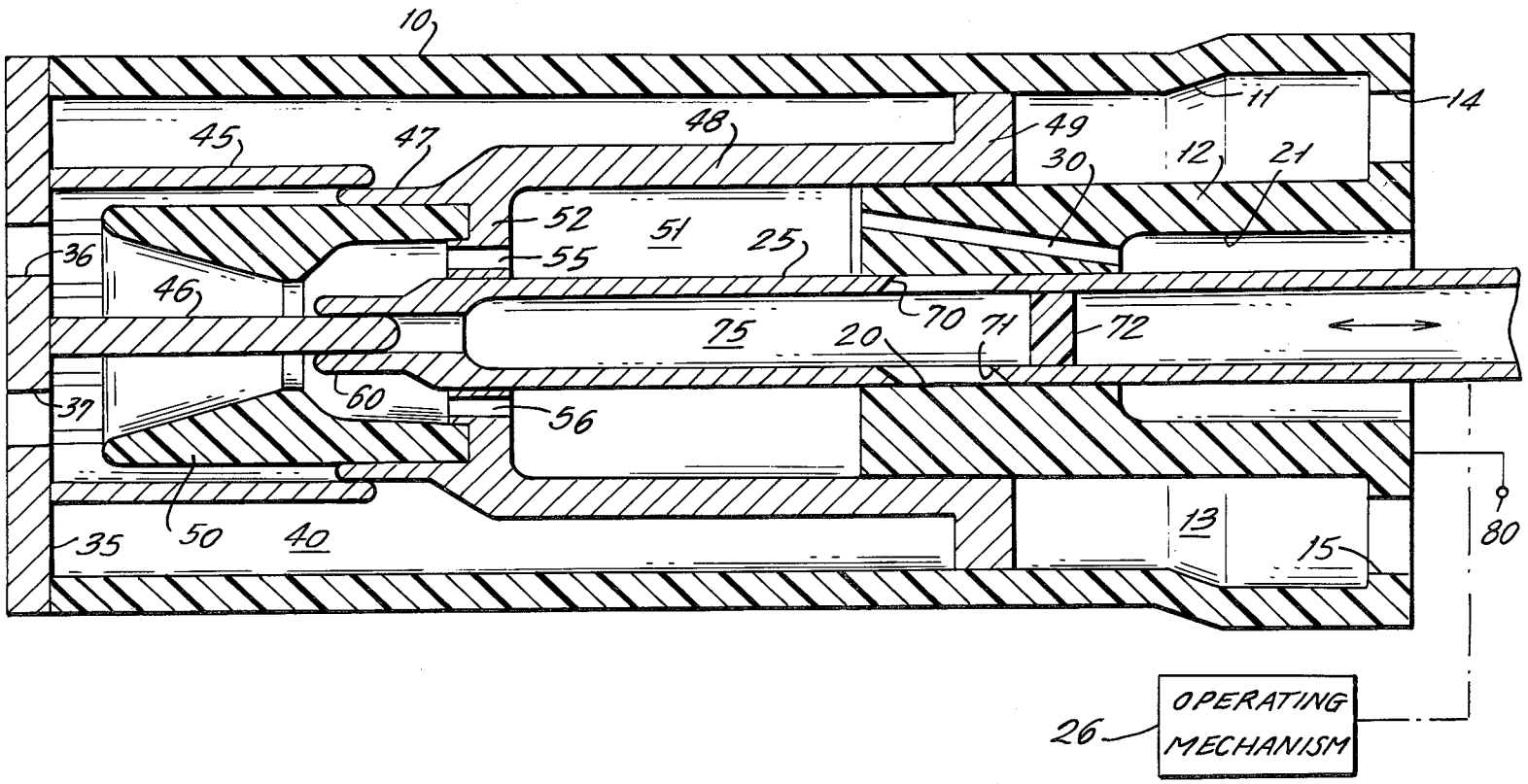
FIG. 1 is a cross-sectional view taken along the axis of a puffer interrupter assembly with the interrupter contacts in their closed position.
Figure 2:
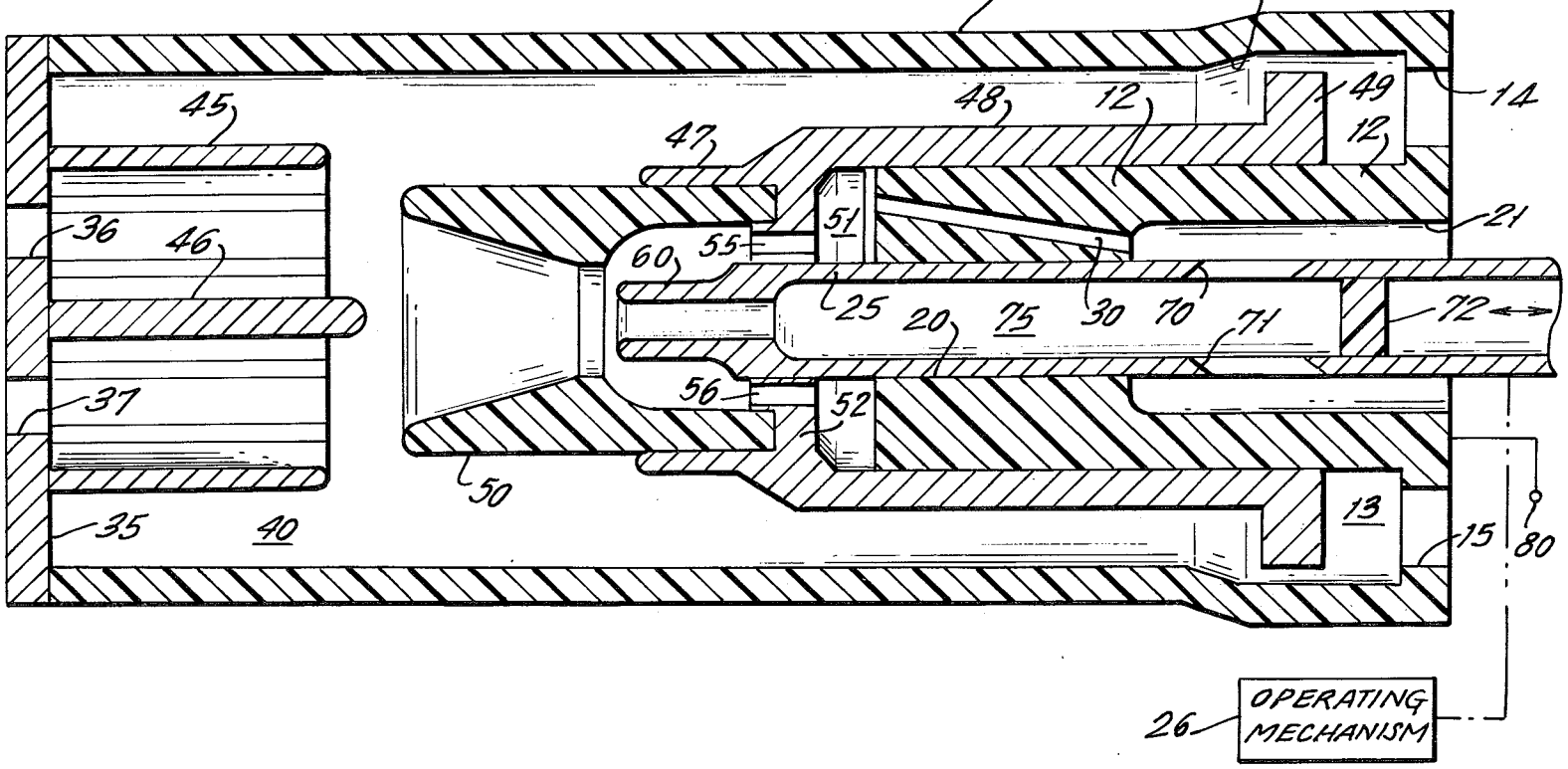
FIG. 2 is a cross-sectional view similar to FIG. 1 but shows the contacts in their fully opened position.

Referring to FIGS. 1 and 2, the puffer interrupter structure consists of a cylindrical outer housing 10 of any desired insulation material. Outer housing 10 has an enlarged internal diameter region 11 and has a central piston 12 fixed to the right-hand end thereof. The interior of housing 10 may be filled with an electronegative gas, such as sulfur hexafluoride. The fixed piston 12 can be an integral part of housing 10 or can be formed of separately machined parts which are appropriately secured to the housing 10.

The stationary piston 12 defines, with the interior of housing 10, a volume 13 which communicates to the exterior of the housing 10 through openings, such as openings 14 and 15 in the right-hand end wall of housing 10. Piston 12 is further provided with a central opening 20 which communicates with an enlarged diameter opening 21 which extends to the right-hand end of housing 10. Stationary piston 12 may also have a gas relief channel 30 extending therethrough, and equipped with a one way check valve to refill volume 51 during closing.

Opening 20 slidably receives and guides a movable arcing contact rod 25. The movable arching contact rod 25 is connected to a conventional operating mechanism 26 which is exterior of housing 10 and is operable to move the movable arcing contact rod 25 and the assembly connected thereto, as will be later described, between the closed position of FIG. 1 and the open position of FIG. 2. The purpose of this invention is to reduce the maximum energy which must be available from operating mechanism 26 to operate the interrupter for interruption of relatively high fault currents.

The left-hand end of housing 10 is secured to a conductive plate 35 which has a plurality of openings such as openings 36 and 37 extending therethrough in order to connect the volume 40 within the interior of housing 10 to the exterior of the housing. Conductive plate 35 can serve as one terminal of the interrupter and has extending therefrom and secured thereto a conventional circular cluster of stationary contact fingers 45 and a central stationary arcing contact 46. Note that the arcing contact 46 is longer than the main stationary contact cluster 45 for reasons which will later become apparent.

Stationary contacts 45 telescopically receive the main movable contact cylinder defined by the reduced diameter end 47 of conductive cylinder 48. Note that end portion 47 defining the main contact and cylinder 48 can be a composite member. In the embodiment shown, however, the cylinder 48 acts as the cylinder of the puffer and is telescopically received over the stationary piston 12.

Movable cylinder 48 is provided with a novel end flange 49 which is slidably received within the interior diameter of housing 10 and serves generally as a gas barrier between volumes 40 and 13. The interior of the movable contact end portion 47 receives a conventional insulation nozzle 50 which defines an orifice for the flow of gas from the volume 51 formed between cylinder end portion 52 and the left-hand end of piston 12 to the volume within the interior of nozzle 50. A plurality of openings, such as openings 55 and 56, are provided in the wall 52 to define a gas flow path from volume 51 into the nozzle interior region.

The movable arcing contact 25 terminates in a nozzle 60 which telescopically receives the end of stationary arcing contact 46 when the puffer is in the closed position of FIG. 1. The length of the arcing contact 46 relative to the length of the main contact 45 is such that when the puffer is moved to its open position, contacts 45 and 47 will separate before contacts 46 and 60 separate. Therefore, the major arcing duty will occur between the arcing contacts 46 and 60 which can be made of known conductive materials especially adapted to resist arcing.

The movable arcing contact 25 is further provided with a plurality of openings such as openings 70 and 71 and a gas blocking insert 72. This arrangement defines a flow path for gas, in FIG. 2, through the interior 75 of contact 25 through the vents 70 and 71 and into the interior of opening 21 in the piston 12. However, when the interrupter is closed, the vents 70 and 71 are sealed by the interior diameter 20 of the piston 12, as shown in FIG. 1.

The operation of the device of FIGS. 1 and 2 is as follows:

When the interrupter is in the closed position of FIG. 1, a current path exists from conductive plate 35 through the parallel closed contacts 45–47 and 46–60 then into the conductive cylinder 48 and then into the piston 12. The piston 12 may have an electrical terminal, such as terminal 80, of any suitable design connected thereto. The piston 12 can include any appropriate sliding connection arrangement. Alternatively, the terminal arrangement can be connected to the movable stationary contact 25.

In order to open the interrupter, the operating mechanism 26 exerts a force on the movable arcing contact 25 to move the contact 25 to the right. At the same time, the cylinder 48 and nozzle 50 which are fixed to the movable arcing contact 25 will move to the right. In moving toward the position of FIG. 2, the main contact 47 will disengage from the main stationary contact cluster 45 and the current being interrupted is commutated into the still closed arcing contacts 46 and 60. During travel of the cylinder 48, and while the arcing contacts 46 and 60 are still engaged, the volume 51 between the cylinder 48 and piston 12 decreases and the pressure of the gas within this volume 51 begins to increase.

At the instant the arcing contacts 46 and 60 separate, a gas flow has been established across the interrupter nozzle 50 from the volume 51. Some of this gas flows through orifices 36 and 37 to provide a gas flow within the stationary contact structure. This gas flow through the interior of cluster 45 and to the exterior of the puffer housing 10 is mainly responsible for facilitating the dielectric recovery process across the contacts. This gas flows axially through the electric arc which appears across the separating contacts 46 and 60.

The energy released by the arc is transferred to the gas within the circuit breaker chamber 40 to further increase its pressure. As the pressure within the volume 40 increases, a force is also produced on the enlarged diameter surfaces of cylinder 48, particularly the flange 49 which face the left-hand end of the puffer interrupter housing. This force is in the same direction as the force being applied to the arcing contact 25 by the operating mechanism 20. If the arc current is high, the arc energy released into the gas within volume 40 is also high and the gas pressure in volume 40 is also high. Therefore, a larger force is applied to the moving contact assembly to assist the operating mechanism 26 in moving the mechanism toward its open position of FIG. 2.

During the interruption process, a point is reached when the openings 70 and 71 of the arcing contacts 25 pass to the right of opening 20. At this point a gas flow path is established through the interior of the arcing contact 25 so that gas can now flow in two directions through the arc; into the interior of the left-hand end of contact 25, and through the vents 36 and 37. This double flow of gas is favorable for interruption of the arc between the arcing contacts 46 and 60.

As the movable contact 47 reaches a point near the end of its opening stroke, the flange 49 moves adjacent to the enlarged diameter region 11 of housing 10. This allows pressure within volume 40 to be released into the total gas volume of the breaker, thus mixing the heated gas of volume 40 with the cooler gas in the exterior areas such as volume 13 and the areas of the space connected to volume 13 through vents 14 and 15. This then equalizes the pressure across the flange 49 and prepares the breaker for its next operation and enables easy reclosing of the breaker by the operating mechanism 26.

During the interruption operation, the pressure increase in volume 40 and therefore the additional force assist on the driving force acting upon cylinder 48 are dependent upon the arc energy produced by the arc. This is, in turn, proportional to the current being interrupted. Consequently, the compression rate of the gas within volume 40 and the assist force applied to cylinder 48 become a function of the current being interrupted.

During interruption of low currents and interruption of load currents and low to medium fault currents, the interrupter will act as a conventional puffer interrupter. That is, the gas within volume 51 will be compressed by cylinder 48 but no significant arc energy induced pressure is generated in the volume 40, so that a modestly sized operating mechanism can provide the necessary differential pressure across nozzle 50 and the breaker experiences little difficulty of interruption. For larger currents, which would otherwise require a substantial increase in operating mechanism energy to operate the interrupter, the arc energy liberated produces a substantial increase in the gas pressure within volume 40 to produce an assist force for the operating mechanism 26 which assist force increases as a function of the current being interrupted.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A puffer interrupter which employs arc energy assist for its opening operation; said puffer interrupter comprising an elongated housing having a stationary contact means fixed therein and a stationary piston fixed therein; said stationary piston telescopically receiving a movable cylinder; said movable cylinder having a movable contact means fixed thereto and having an insulation nozzle fixed thereto; said movable contact means being movable with said cylinder and said nozzle between an engaged and disengaged position with respect to said stationary contact means; said insulation nozzle defining an axial gas flow path which surrounds the arcing space between said movable and stationary contact means when said movable contact means separates from said stationary contact means; said movable cylinder and said piston defining a compressible volume which is connected to the interior of said nozzle and which is compressed when said movable contact means moves to said disengaged position; said cylinder having an enlarged outer flange which moves within and is slidably sealed to the interior of said elongated housing for at least a portion of the motion of said cylinder within said housing; the volume surrounding said insulation nozzle communicating with one surface of said flange so that an increase in pressure within said last mentioned volume produces a differential force which tends to move said movable contact means towards said disengaged position; said movable contact means comprising a tubular main contact and a concentric tubular movable arcing contact disposed coaxially and interiorly of said tubular main contact; said stationary contact means comprising a tubular main stationary contact which telescopically receives said tubular main contact in said engaged position, and a central stationary arcing contact rod which telescopically engages said tubular movable arcing contact when said movable contact means is in its said engaged position; said movable and stationary arcing contact means having a deeper telescopic region of engagement than said tubular movable and stationary main contacts whereby said movable and stationary arcing contacts are the last to disengage when said cylinder is moved to said disengaged position; said nozzle being disposed in the annular space between said tubular main contact and said tubular movable arcing contact.

2. A puffer interrupter which employs arc energy assist for its opening operation; said puffer interrupter comprising an elongated housing having a stationary contact means fixed therein and a stationary piston fixed therein; said stationary piston telescopically receiving a movable cylinder; said movable cylinder having a movable contact means fixed thereto and having an insulation nozzle fixed thereto; said movable contact means being movable with said cylinder and said nozzle between an engaged and disengaged position with respect to said stationary contact means; said insulation nozzle defining an axial gas flow path which surrounds the arcing space between said movable and stationary contact means when said movable contact means separates from said stationary contact means; said movable cylinder and said piston defining a compressible volume which is connected to the interior of said nozzle and which is compressed when said movable contact means moves to said disengaged position; said cylinder having an enlarged outer flange which moves within and is slidably sealed to the interior of said elongated housing for at least a portion of the motion of said cylinder within said housing; the volume surrounding said insulation nozzle communicating with one surface of said flange so that an increase in pressure within said last mentioned volume produces a differential force which tends to move said movable contact means towards said disengaged position; said housing having an enlarged interior periphery portion which axially receives said enlarged outer flange during the movement of said cylinder toward said disengaged position; said enlarged interior periphery portion being spaced from the outer periphery of said flange to release the sliding seal between said flange and said housing; said enlarged interior periphery portion being disposed at an axial position within said housing which is reached by said flange near the end of the axial movement of said cylinder toward said disengaged position.

3. The interrupter of claim 2 in which said movable contact means comprises a tubular main contact and a concentric tubular movable arcing contact disposed coaxially and interiorly of said tubular main contact; said stationary contact means comprising a tubular main stationary contact which telescopically receives said tubular main contact in said engaged position, and a central stationary arcing contact rod which telescopically engages said tubular movable arcing contact when said movable contact means is in its said engaged position.

4. The interrupter of claim 2, wherein said movable and stationary arcing contact means have a deeper telescopic region of engagement than said tubular movable and stationary main contacts whereby said movable and stationary arcing contacts are the last to disengage when said cylinder is moved to said disengaged position.

5. The interrupter of claim 3, wherein said nozzle is disposed in the annular space between said tubular main contact and said tubular movable arcing contact.

6. The interrupter of claim 2, wherein said nozzle is disposed in the annular space between said tubular main contact and said tubular movable arcing contact.

7. The interrupter of claim 1, in which said housing has an enlarged interior periphery portion which axially receives said enlarged outer flange during the movement of said cylinder toward said disengaged position; said enlarged interior periphery portion being spaced from the outer periphery of said flange to release the sliding seal between said flange and said housing; said enlarged interior periphery portion being disposed at an axial position within said housing which is reached by said flange near the end of the axial movement of said cylinder toward said disengaged position.

8. The interrupter of claim 1 or 2 which further includes external operating mechanism means connected to said movable contact means for moving said movable contact means, said cylinder and said nozzle between said engaged and disengaged positions; said operating mechanism means having sufficient energy for operating said movable contact means, said cylinder and said nozzle to said disengaged position in the presence of relatively low power arcs between said movable and stationary contact means; the added energy needed to move said movable contact means, said cylinder and said nozzle during arcs of higher power than said relatively low power arcs being derived from the pressure applied to said one surface of said flange.

9. The interrupter of claim 1 or 2 wherein said housing is filled with an electronegative gas.

10. The interrupter of claim 8, wherein said housing is filled with an electronegative gas.

11. The interrupter of claim 1 or 2 wherein said tubular movable arcing contact has a continuous cylindrical portion extending from a free contact tip; said continuous cylindrical portion being slidably mounted and guided for movement in an elongated opening extending through said piston.

12. The interrupter of claim 11, which further includes external operating mechanism means connected to said movable contact means for moving said movable contact means, said cylinder and said nozzle between said engaged and disengaged positions; said operating mechanism having sufficient energy for operating said movable contact means, said cylinder and said nozzle to said disengaged position in the presence of relatively low power arcs between said movable and stationary contact means; the added energy needed to move said movable contact means; said cylinder and said nozzle during arcs of higher power than said relatively low power arcs being derived from the pressure applied to said one surface of said flange.

13. The interrupter of claim 11, wherein said continuous cylindrical portion of said tubular movable arcing contact has vent means therein; said vent means being closed by the wall of said elongated opening in said piston when said cylinder is in said engaged position; said vent clearing the end of said opening when said cylinder is moved through a given distance toward said disengaged position, thereby to open channel through said tubular movable arcing contact for exhaust of gas from the arcing region between said movable and stationary contact means.

14. The interrupter of claim 13, wherein said housing is filled with an electronegative gas.

* * * * *